US005908065A

United States Patent [19]

Chadwick

[11] Patent Number: 5,908,065

[45] Date of Patent: Jun. 1, 1999

[54] APPARATUS AND METHOD FOR SQUEEZE CASTING

[75] Inventor: Geoffrey Allan Chadwick, Winchester, United Kingdom

[73] Assignee: Papervision Limited, Southhampton, United Kingdom

[21] Appl. No.: 08/875,084

[22] PCT Filed: Jan. 23, 1996

[86] PCT No.: PCT/GB96/00137

§ 371 Date: Sep. 26, 1997

§ 102(e) Date: Sep. 26, 1997

[87] PCT Pub. No.: WO96/22851

PCT Pub. Date: Jan. 8, 1996

[30] Foreign Application Priority Data

Jan. 23, 1995 [GB] United Kingdom ..... 9501263

[51] Int. Cl.[6] ..... B22D 18/02; B22D 11/06; B22D 27/15; B22D 39/00

[52] U.S. Cl. ..... 164/120; 164/134; 164/136; 164/63; 164/254; 164/319; 164/321; 164/337

[58] Field of Search ..... 164/120, 303, 164/136, 254, 306, 63, 119, 134, 319, 321, 337

[56] References Cited

U.S. PATENT DOCUMENTS

| | | | |
|---|---|---|---|
| 3,608,623 | 9/1971 | Woltering | 164/303 |
| 3,612,153 | 10/1971 | Koch | 164/303 |
| 3,749,154 | 7/1973 | Plume | 164/136 |
| 3,769,673 | 11/1973 | Siepmann | 29/890.12 |
| 4,380,261 | 4/1983 | Suzuki et al. . | |
| 4,446,907 | 5/1984 | Suzuki et al. . | |
| 4,890,665 | 1/1990 | Vetterli | 164/136 |
| 4,967,826 | 11/1990 | Kopp et al. . | |
| 5,119,866 | 6/1992 | Mihara . | |
| 5,211,216 | 5/1993 | Drury et al. . | |
| 5,423,369 | 6/1995 | Ota et al. | 164/120 |
| 5,433,262 | 7/1995 | Kawaguchi et al. | 164/120 |
| 5,462,107 | 10/1995 | Hasegawa et al. | 164/120 |
| 5,562,147 | 10/1996 | Bortoloni | 164/120 |

FOREIGN PATENT DOCUMENTS

| | | | |
|---|---|---|---|
| 0236097A2 | 9/1987 | European Pat. Off. . | |
| 61-119369 | 6/1986 | Japan | 164/120 |
| 63-224854 | 9/1988 | Japan | 164/134 |
| 2-155557 | 6/1990 | Japan | 164/120 |
| 2-229660 | 9/1990 | Japan | 164/120 |
| 3-124366 | 5/1991 | Japan | 164/134 |
| 4-75757 | 3/1992 | Japan | 164/120 |
| 4-182056 | 6/1992 | Japan | 164/136 |
| 1028736 | 5/1966 | United Kingdom . | |
| 2255738 | 11/1992 | United Kingdom . | |
| 2264661 | 9/1993 | United Kingdom . | |
| WO9217296 | 10/1992 | WIPO . | |

OTHER PUBLICATIONS

WPI Abstract Accession No. 91–219675/30 & JP 3142054 A (Toshiba), Abstract.

VDI Zeitschrift, vol. 133, No. 3, Mar. 1, 1991, pp. 127–128, 131–133, XP000219812 Schneider W: "Formgiessverfahren Fuer Innovative Aluminumgussteile".

*Primary Examiner*—Harold Y. Pyon
*Assistant Examiner*—I.-H. Lin
*Attorney, Agent, or Firm*—Smith, Gambrell & Russell, LLP; Beveridge, DeGrandi, Weilacher & Young Intellectual Property Group

[57] ABSTRACT

Squeeze casting of high integrity, near net shape castings is performed in a mould cavity defined by cooperating die parts which are movable with respect to each other and have a separation distance which is selected to define a predetermined cavity volume for the cast article. A conduit has a first end connected to an entrance in the lower die part of the mould cavity and a second end connected to a receptacle which contains molten metal. Molten metal is transferred upwardly from the receptacle through the conduit to fill or substantially fill the mould cavity. The entrance to the mould cavity is sealed, and pressure is applied on the die parts to further reduce the cavity volume during solidification of the metal in the mould cavity.

21 Claims, 3 Drawing Sheets

APPARATUS AND METHOD FOR SQUEEZE CASTING

CROSS-REFERENCE TO RELATED APPLICATIONS

This application is a 371 of PCT/GB96/00137, filed on Jan. 23, 1996.

The present invention relates to an apparatus and method for squeeze casting.

Two types of squeeze casting are known in the prior art end are referred to as direct squeeze casting and indirect squeeze casting. Both processes have been developed for the production of high integrity near net shape castings. However, in order to produce important casting conditions need to be satisfied:

(i) delivery of clean metal to the mould, usually involving filtration;

(ii) non-turbulent flow of metal into the die set after filtration;

(iii) accurate metering of metal into the die cavity;

(iv) full pressurisation of the metal during solidification.

When measured against these criteria, serious drawbacks and limitations are apparent in prior art techniques of both indirect and direct squeeze casting.

Indirect squeeze casting is generally considered to be a modification or development of high pressure die casting. Liquid metal is forced into a closed die cavity from a shot sleeve by a small piston. The piston, normally driven by a hydraulic ram continues to act on the metal in the die cavity during its solidification period. Squeeze pressures are limited by the bore of the piston and the rating of the hydraulic ram. In one method of indirect squeeze casting liquid metal is poured turbulently into a shot sleeve and the metal is non-turbulently displaced upwards into the die cavity by the piston through a gate, the width of the gate being many times larger than the gate used in conventional high pressure die casting. The die may open either vertically or horizontally to release the casting. In a second method of indirect squeeze casting, metal is injected turbulently at high velocity into the die cavity through a narrow gate and the metal is further consolidated in the mould by means of opening the gate wider to allow the piston to move forward to compensate for solidification shrinkage.

Indirect squeeze casting processes generally operate with short cycle times since they are generally based on high pressure die casting practice and hence they tend to be high productivity processes. By the same token, however, these processes are most suited to conventional casting alloys and it has been found difficult to manufacture consistently good castings from high strength aluminium wrought alloys. Even those indirect squeeze casting produced using conventional casting alloys may contain some remnant microporosity in regions remote from the action of the plunger which could be detrimental to the quality of the castings. Furthermore, in most indirect squeeze casting practices it is not feasible to filter the metal just prior to its entry into the die cavity and therefore the oxides present in the melt due to turbulent metal handling procedures inevitably become trapped in the cast article as non-metallic defects. Such defects undermine and diminish the quality of the cast metal product to an extent that cannot be easily quantified and which cannot be readily tolerated.

With regard to metering metal to produce castings of constant size and shape, indirect squeeze casting processes use a closed die to define the casting cavity. Opposing die halves are locked together rigidly by hydraulic cylinders and large toggle during the injection of metal from the shot sleeve and during the metal pressurisation period from the plunger. The only moving part of the equipment during casting is the plunger, which moves to inject metal into the fixed volume die cavity. Side cores may be used in the die to increase the complexity of the casting shape. Although the external form of the cast article may be accurately controlled, indirect due to the presence of microporosity, particularly in regions of the casting remote from the plunger. Excess metal comprising the runners and wad, which may constitute over fifty percent of the total shot mass, needs to be removed from the casting after ejection from the die.

Of the four casting conditions listed above as prerequisites for the highest quality castings, indirect squeeze casting only satisfies the third requirement, namely, the accurate metering of metal into the die cavity.

Direct squeeze casting differs from indirect squeeze casting in several important ways. In the prior art direct squeeze castings are generally made in a vertically acting hydraulic press. Liquid metal is poured from a spoon or robotic ladle or down a launder into a lower die cavity situated on the lower platen of the hydraulic press and the top part of the die is lowered by means of movement of the upper platen into the lower die cavity to displace liquid metal so as to fill the entire die cavity. Pressure from the hydraulic press continues to act on the metal in the mould during its solidification period by the continued movement of the top part of the die, or punch, into the lower part of the die assembly, or lower die cavity. The pressure on the casting during solidification is governed only by the working capacity of the hydraulic press. No runners or risers are required and the direct squeeze casting process is extremely efficient in metal utilisation for near net shape castings.

The major advantage of direct squeeze casting over indirect squeeze casting is the application of pressure over the entire or larger part of the surface area of the casting by the movement of the punch within the lower die half. Because of this relative movement of the two die halves, the cast metal is very effectively squeezed throughout its freezing period and is pressurised even in the remotest regions of the casting. Hence, liquid metal fluidity is not a prime requirement of direct squeeze casting and alloys other than conventional casting alloys may be used. Forging alloys, metal matrix composites of particulate ingot and preform infiltration varieties, together with other "difficult to cast" alloys, in addition to conventional casting alloys, have all been cast using the direct squeeze casting route.

In the prior art of direct squeeze casting, liquid metal has invariably been fed into the lower die cavity from above in a turbulent fashion. Although filters can be placed, for instance, in the path of the metal stream as it travels down a launder system, the metal finally entering the die will inevitably do so in a turbulent manner and will consequently generate more oxide films which become engulfed in the casting.

Another problem, concerned with metal metering, also stems from the fact that the two halves of the die set are, of necessity, set widely apart initially in order to allow liquid metal ingress. In such circumstances or die filling, the only means to date of metering metal into the cavity has been by the timing of metal flow from a dosing furnace or by using ladles of a given volumetric capacity. In both cases, variations in casting mass may occur, leading to variations in the through thickness of the direct squeeze castings which may place the castings outside acceptable tolerance limits. One way of addressing this problem has been to allow excess metal to flow out of the die set through gaps or windows between the punch and the lower half as the punch enters the lower half prior to pressing. This procedure has not been found to be a completely satisfactory solution to the problem and it has not been widely adopted in practice.

Thus, direct squeeze casting as practised currently can be seen to suffer from serious limitations and satisfies only one of the pre-requisites listed above for the highest integrity castings, namely, the full pressurisation of the cast metal during solidification. In-line filtration can also be achieved if an appropriate launder system is used but it cannot be implemented for the commoner practices using robotic ladling of liquid metal into the die set. It will be appreciated that direct squeeze casting as used in the prior art tends to be a cumbersome process combining, as it does, gravity die casting with closed die forging. The resultant questionable cast metal quality together with an inherently low process productivity have restricted the industrial application of direct squeeze castings.

Therefore, there exists a need for a high productivity direct squeeze casting process which is capable of producing the highest quality near net shape castings in high strength alloys at an economically viable production rate.

In one respect the invention is an apparatus for casting metal articles comprising a receptacle for molten metal, and co-operating upper and lower die parts which define at least one mould cavity for casting the metal article. The die parts are movable with respect to each other, and their separation distance is selected to define a predetermined cavity volume for the cast article. Pressurising means are provided to apply pressure on the die parts to further reduce the cavity volume during solidification of the metal in the mould cavity. A conduit has a first end connected to an entrance in the lower die part and a second end connected to the receptacle. Means are provided for transferring molten metal upwardly from the receptacle through the conduit to fill or substantially fill the mould cavity in a non-turbulent manner. Sealing means which seals the entrance to the lower die part is below the lower die part and includes a sliding gate located between the first end of the conduit and the entrance in the lower die part.

By these means, squeeze castings free or substantially free from porosity can be produced to near net shape in a process that can be operated repetitively at high production rates to produce high quality products at acceptable cost.

Preferably, the apparatus further comprises opening means to open the mould.

Preferably, the apparatus comprises extraction means to remove the cast article from the mould cavity.

Preferably, the receptacle for molten metal is a heatable furnace.

Preferably, the receptacle for molten metal is an unheated reservoir.

Preferably, each die part is supported on a platen of which at least one platen is slidable one or more tie bars.

Preferably, the means for transferring molten metal in the conduit is a low pressure pneumatic system.

Preferably, the means of transferring molten metal in the conduit is an electromagnetic pump.

Preferably, the means of transferring molten metal in the conduit is a vacuum system to create a negative pressure in the mould relative to the receptacle.

Preferably, the sliding gate is manufactured from an inert material capable of forming a leak-tight closure.

Preferably, the sealing means comprises a slide track such that the die parts are slidable upon it to enable the entrance to the mould cavity to be taken out of feeding relationship with the conduit.

Preferably, the slide track is manufactured from an inert material capable of forming a leak-tight closure.

Preferably, the sealing means comprises a stopper located within the mould cavity above the entrance to the mould cavity which can be lowered to seal the entrance to the mould cavity.

Preferably, the pressure applied by the pressurising means during solidification progressively deforms and compresses the solidified metal in the mould to compensate for contraction during solidification to ensure the removal or substantial removal from the casting of contraction cavities or remnant gas porosity from gases dissolved in the metal.

Preferably, the pressurising means has a variable speed of operation.

Preferably, monitoring means are provided to monitor the pressure applied and the displacement produced by the pressurising means and to generate a specific pressurisation and/or displacement regime.

Preferably, the apparatus further comprises a filtration means to filter the molten metal prior to entering the mould cavity.

Preferably, there are a plurality of mould cavities.

Preferably, the lower die part is encased in a steel bolster.

Preferably, the upper die part is held on a steel backing plate or support block.

Preferably, the die parts are provided with heating/cooling means.

Preferably, the separation of the die parts is determined by displacement transducers.

Preferably, the separation of the die parts is determined by compressible separators.

Preferably, the pressurising means is a hydraulic press.

Preferably, the die parts comprise impression blocks manufactured in one or more interlocking segments from hardened and tempered steel.

Preferably, the surfaces of the mould cavity are coated with a lubricant or release agent.

The invention also involves a method of casting metal articles, wherein a mould which has at least one mould cavity of variable volume is located above a receptacle which contains molten metal. A conduit has a first end connected to an entrance in the mould and a second end connected to the receptacle. Molten metal is forced upwardly from the receptacle through the conduit and into the mould cavity without turbulence. The loss of molten metal from the mould cavity is prevented by sealing the entrance to the mould with a sliding gate which is moved from an open position which is below the mould cavity to a closed position which is also below the mould cavity. During solidification of the molten metal, pressure is applied to the mould cavity to reduce its volume, thereby compensating for contraction during solidification.

Preferably, the pressure is reduced after solidification is completed.

Preferred embodiments of the present invention will now be described, by way of example only, with reference to the accompanying drawings of which:

Figure 1:
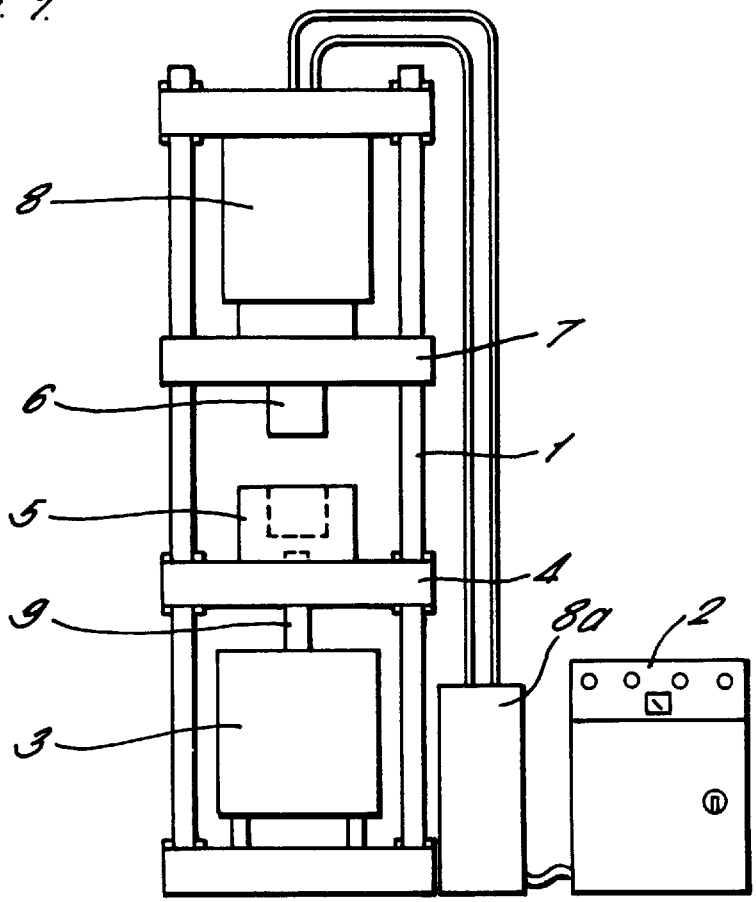
FIG. 1 shows the general construction of the direct squeeze casting apparatus.

FIG. 1 shows the general assembly of direct squeeze casting equipment comprising the hydraulic press 1 with its control/operations panel 2 and the pumping furnace 3 located approximately centrally below the lower platen 4 of the hydraulic press 1. The control/operations panel 2 includes means for monitoring the pressure applied and the displacements produced by the press 1 during solidification, and to generate a specific pressurisation and/or displacement regime. In this embodiment the lower die half 5 which may itself be constructed of separate segments which define the form of the lower surfaces of the casting and which may be held together in a robust steel bolster, is held rigidly on the lower platen 4 by bolts, jacks, levers or the like. The punch or upper die half 6 which may itself be constructed of separate segments and which defines the form of the upper surfaces of the casting, is attached directly or indirectly via a backing plate or a support block to the upper platen 7 above the lower die half and can be lowered into and raised from it to open the mould be means of the operation of the hydraulic cylinder or cylinders 8 and the associated hydraulic pumps 8*a* of the hydraulic press 1. The die parts 5,6 and any cores which may be part of the die construction may be sprayed with a graphitic or other die lubricant prior to assembly in their correct locations ready for casting. The upper part of the die 6 is positioned, with the aid of displacement transducers, limit switches or other similarly suitable devices, within the lower part of the die 5 to define a metal metering means. The pumping furnace 3 holds a supply of molten metal in a receptacle and transfers the molten metal upwardly through a conduit 9 to the mould. The metal metering means is such that the volume of liquid metal which will enter the cavity from the conduit 9 will, subsequent to sealing the entrance to the mould and after solidification and simultaneous compression and compaction by the main free or substantially free from porosity and of the required dimensions. Usually the dies are operated at a temperature within the range 250° C.–350° C. and they may be heated or cooled to maintain their means. The heating may be applied directly to the impression blocks or to the bolster and support block of the upper an lower parts respectively.

Figure 2:
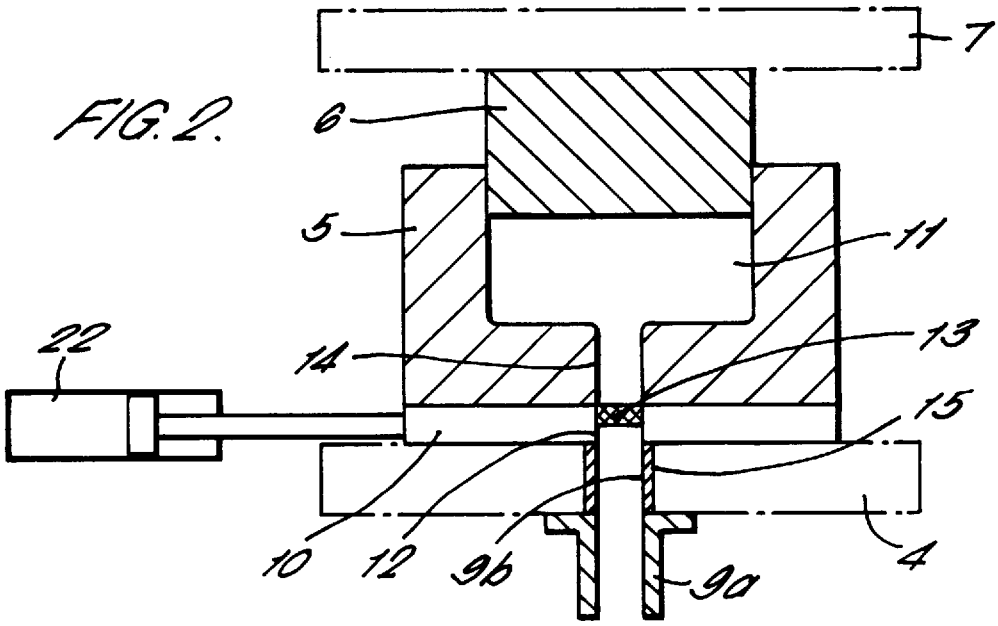
FIG. 2 shows an enlarged view of the mould and sliding gate assembly in FIG. 1.

FIG. 2 shows an enlarged view of a die set 5 and 6 located centrally on the platens 4 and 7 above the conduit 9, which comprises a riser tube 9*a* from the furnace 3 and a channel 9*b* in the lower platen, with the sliding gate 10 situated between the top of the conduit and the bottom of the die cavity 11, the sliding gate being operated by the hydraulic cylinder 22. The orifice 12 in the sliding gate 10, which may be lined with ceramic or other inert material, lines up with the conduit 9 when the gate is open to allow metal to pass upwardly from the conduit 9 into the mould cavity 11 through a filtering medium 13 situated within the orifice 12 of the sliding gate 10 or at any suitable position within the mould entrance 14. The channel 9*b* in the lower platen 4 and in any backing plates between the lower die half 5 and the lower platen 4 may be lined with inert ceramic material 15. When the correct amount of metal has passed into the mould cavity the sliding gate 10 is moved by a distance greater than the diameter of the orifice 12 to displace the orifice 12 in the sliding gate 10 fully out of alignment with the conduit 9 and thus to isolate the liquid metal in the mould cavity 11 from the metal in the conduit 9. At this stage pressure can be reduced in the pumping furnace 3 to allow the descent of liquid metal in the conduit 9. To facilitate the removal of liquid from beneath the under surface of the sliding gate 10, the underside of the sliding gate 10 may contain a venting passage to allow the ingress of air into the top of the conduit 9 when the venting passage and the inner edge of the conduit are placed in juxtaposition by the further movement of the sliding gate 10. The contacting surfaces above and below the sliding gate may be of a material different from the sliding gate 10 to reduce frictional effects and to prevent any potential seepage of liquid metal into the sliding mechanism.

Figure 3:
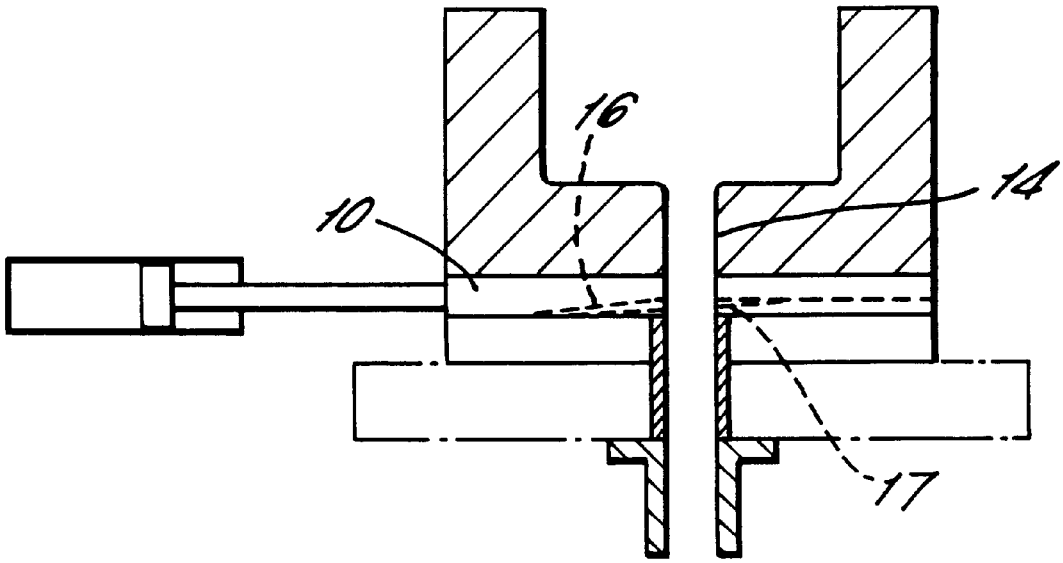
FIG. 3 shows enlarged details of the sliding gate and the upwardly acting locking mechanisms in FIG. 2.

The sliding gate 10 can be secured in its unaligned position to form a leak-tight seal by forcing it from below against the lower end of the mould entrance 14. In FIG. 3 the upwardly acting force on the sliding gate 10 may be generated from the interaction of the inclined surfaces 16 in the sliding gate against the inclined ramps 17 on the underlying surface. The mechanical or hydraulic action of levers or toggles or the like may also be used to effectively seal the sliding gate 10 against the lower end of the mould entrance 14. Once a lead-tight seal has been formed the pressure of the hydraulic ram 8 acting through the punch 6 can be brought to bear on the metal in the cavity 11 throughout the solidification period. When the casting has solidified any side cores can be withdrawn, the punch 6 can be retracted by the reverse action of the main cylinder or cylinders 8 or by the action of ancillary cylinders and the casting can be removed. The small disc of solidified aluminium in the orifice 12 in the sliding gate 10 can easily be removed by a sprung ball mechanism, for instance, and the die set can be reassembled for further casting. This method of operation is suitable for the larger size of castings in heavy steel moulds and bolsters. This arrangement of die filling and sealing is suitable, for example, for the manufacture of automotive components such as steering knuckles, wheel hub castings, light alloy wheels and other shapes for general engineering applications.

Figure 4:
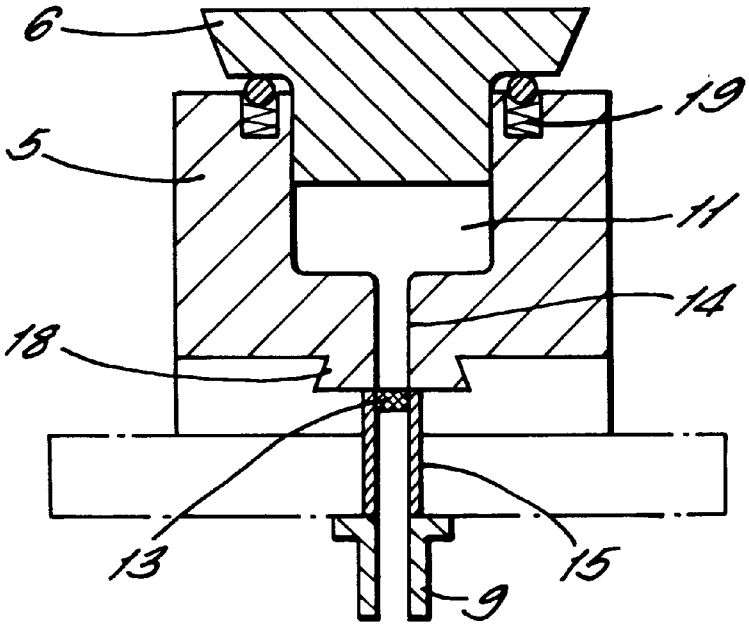
FIG. 4 illustrates a preferred metering mechanism using compressible separators with a sliding mould.

An alternative arrangement for metal metering and mould sealing is shown in FIG. 4, in which the bottom half of the die set 5 is situated on a raised or recessed slide track 18 and is moved with respect to the conduit 9 to place the mould into or out of feeding relationship with the furnace 3 and simultaneously out of or into coaxiality with the hydraulic press 1. In this embodiment the mould entrance 14 is initially located over the conduit 9 and metal enters the mould from below in a non-turbulent manner through a filtering mechanism 13 located in the liquid metal flow path below the mould entrance 14 or at any suitable position within the mould entrance 14. Metering of the correct amount of liquid metal into the mould is effected through having the top half of the die 6 situated within the lower half of the die 5 so defining the mould cavity 11 but raised on, preferably adjustable, compressible separators 19 by an amount which just compensates for the volume contraction of the liquid metal on solidification and compaction by the squeezing forces of the hydraulic press 1.

Figure 5:
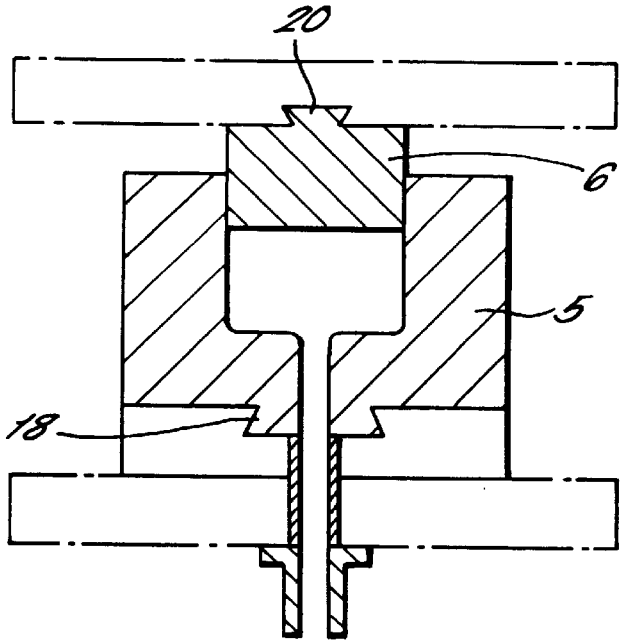
FIG. 5 illustrates an alternative metering mechanism with a sliding mould and punch.

Instead of being situated on compressible supports 19 as shown in FIG. 4 the top half of the die 6 may alternatively be held at the required metal metering height on its own slide track 18 attached directly or indirectly to the top platen and directly above the lower slide track as shown in FIG. 5. The synchronous sideways sliding movement of the two halves of the die may be actuated by a single hydraulic cylinder acting in the line of the slide tracks with the punch 6 being moved by interaction with the lower half 5, or vice versa, or by the cylinder acting jointly on the two die halves; or by a pair of cylinders acting simultaneously on the two halves.

After filling the mould with the requisite amount of liquid metal in either of the embodiments shown in FIGS. 4 and 5, the top half 6 and the bottom half 5 of the mould are together moved sideways out of feeding relationship with the conduit 9 to a position near the centre of the platens of the hydraulic press. At the end of this movement the punch 6 in FIG. 4 can engage securely in a seating such as a tapered keyway or some other interlocking or interacting device on the underside of the upper platen 7 in order to create a withdrawal mechanism for the punch when the casting has solidified. Preferably, pressure is brought to bear on the bottom half of the mould by ancillary hydraulic or pneumatic pistons or by mechanical devices to seal the entrance to the mould by making a leak-proof joint between the die and the lower slide track. Pressure from the hydraulic press is then applied to the punch 6 of the die set such as to displace the punch to compensate for solidification contraction until the liquid metal fully solidifies. The die set can then be opened and the casting removed.

The arrangements of die filling and sealing described in the embodiments shown in FIGS. 4 and 5 are suitable, for instance, for piston manufacture for automotive and other applications which may be of monolithic light alloy composition or metal matrix composite construction, although other automotive and general engineering components are also suitable for this process.

Figure 6:
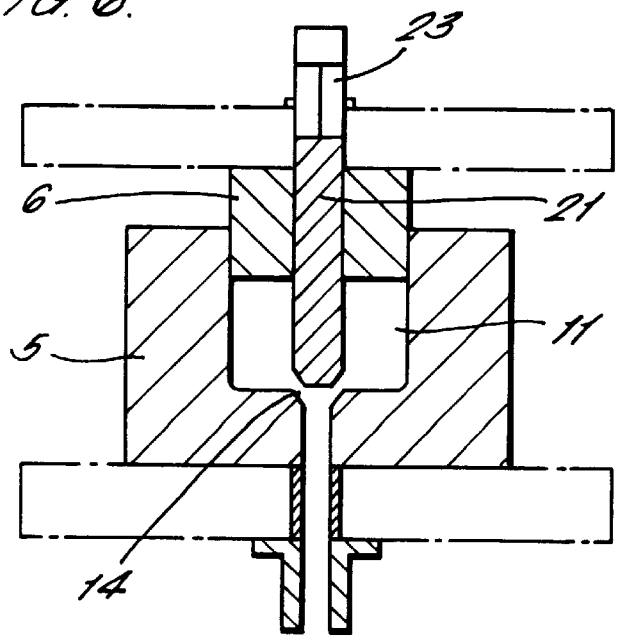
FIG. 6 shows an alternative sealing mechanism.

Another alternative way of sealing the mould is illustrated in FIG. 6 in which the moving part 21 of the sealing means is held in the upper part of the die 6. After being coated with the necessary die lubricant the die halves are initially set at the appropriate distance apart such that the correct quantity of liquid metal is metered into the die cavity 11 when the die cavity is filled from below. The moving part 21 of the sealing means can then be lowered by actuation of an ancillary hydraulic cylinder 23 or by pneumatic or mechanical devices through the liquid metal to seat on the entrance to the mould 14 in the lower half of the die 5 and to effectively seal it to prevent the flow of liquid from the mould during the pressurisation cycle of the hydraulic press. Pressure can be exerted on the moving part 21 of the sealing means by the ancillary hydraulic cylinder 23 or by other pneumatic or mechanical devices to ensure that a pressure tight joint exists to prevent the loss of metal from the mould. Once the seal has been made secure the squeezing pressure from the main hydraulic cylinder 8 can be applied to consolidate the casting during solidification. After solidification the moving part 21 of the sealing means can be withdrawn by reverse actuation of the ancillary hydraulic cylinder 23 or pneumatic piston or by release of the mechanical devices, the die set can be opened using the return action of the main hydraulic cylinder or cylinders 8 and the casting can be removed from the mould cavity. This embodiment of the direct squeeze casting process is particularly suitable for components which require a through hole such as steering knuckles and wheels or wheel centres, for instance, and for moulds containing multiple cavities arranged around a common ingate.

In the general procedures described above, the punch 6 is located in its metal metering position prior to metal entering the die. However the lowering of the punch 6 to its metering position in the lower half of the die 5 to define the die cavity can occur simultaneous with mould filling, or even subsequent to mould filling but prior to mould sealing, in order to promote enhanced liquid metal movement in the die cavity and to encourage more refined microstructure in the cast article. Such a procedure will also provide shorter manufacturing times and greater productivities, particularly for large volume castings.

By following the manufacturing routes described, a range of articles can be produced which are near net shape and contain little or no porosity. By placing filers in-line with the metal flow large oxide particles and other deleterious solid inclusions may be removed from the casting and high integrity castings are produced. By this process conventional casting alloys and alloys of conventional and non-conventional forging composition may be successfully cast into products close to final form. Local reinforcement of the castings can also be effected by the placement of ceramic or metallic preforms at selected locations in the cavity which are fully infiltrated during casting to produce metal matrix composite regions having enhanced properties.

Although reference has been made specifically to light alloys, it should be noted that other non-ferrous and ferrous alloys, particulate metal matrix composites and semi-solid alloys, may also be squeeze cast using the method and apparatus described. For the high temperature alloys, die sets constructed, at least in part, of heat resistant ceramic materials such as sialons may have to be used.

I claim:

1. An apparatus for casting metal articles comprising a receptacle for molten metal, at least one mould cavity for casting the metal article, the mould cavity being defined by co-operating upper and lower die parts, the die parts being movable with respect to each other and their separation distance being selected to define a predetermined cavity volume for the cast article, a conduit having a first end connected to an entrance in the lower die part of the mould cavity and a second end connected to the receptacle, means for transferring molten metal upwardly from the receptacle through the conduit to fill or substantially fill the mould cavity in a non-turbulent manner, sealing means being provided to seal the entrance to the lower die part, wherein pressurising means are provided to apply pressure on the die parts to further reduce the cavity volume during solidification of the metal in the mould cavity, the sealing means being below the lower die part and comprising a sliding gate located between the first end of the conduit and the entrance in the lower die part.

2. An apparatus as claimed in claim 1, further comprising opening means to open the mould.

3. An apparatus as claimed in claim 1, wherein the receptacle for molten metal is a heatable furnace.

4. An apparatus as claimed in claim 1, wherein the receptacle for molten metal is an unheated reservoir.

5. An apparatus as claimed in claim 1, wherein each die part is supported on a platen of which at least one platen is slidable on one more tie bars.

6. An apparatus as claimed in claim 1, wherein the means for transferring molten metal through the conduit is an electromagnetic pump.

7. An apparatus as claimed in claim 1, wherein the sliding gate is manufactured from an inert material capable of forming a leak-tight closure.

8. An apparatus as claimed in claim 1, wherein the sealing means comprises a slide track such that the die parts are slidable upon it to enable the entrance to the mould cavity to be moved away from the conduit.

9. An apparatus as claimed in claim 1, wherein the slide track is manufactured from an inert material capable of forming a leak-tight closure.

10. An apparatus as claimed in claim 1, wherein the pressure applied by the pressurising means during solidification progressively deforms and compresses the solidified metal in the mould to compensate for contraction during solidification and to ensure the removal or substantial removal from the casting of contraction cavities or remnant gas porosity from gases dissolved in the metal.

11. An apparatus as claimed in claim 1, wherein the pressurising means has a variable speed of operation.

12. An apparatus as claimed in claim 1, wherein monitoring means are provided to monitor the pressure applied and the displacement produced by the pressurising means during solidification and to generate a specific pressurisation and/or displacement regime.

13. An apparatus as claimed in claim 1, further comprising a filtration means to filter the molten metal prior to entering the mould cavity.

14. An apparatus as claimed in claim 1, wherein there are a plurality of mould cavities.

15. An apparatus as claimed in claim 1, wherein heating/cooling means are provided for the die parts.

16. An apparatus as claimed in claim 1, wherein the separation of the die parts is determined by displacement transducers.

17. An apparatus as claimed in claim 1, wherein the separation of the die parts is determined by compressible separators.

18. An apparatus as claimed in claim 1, wherein the pressurising means is a hydraulic press.

19. A method of casting metal articles comprising the steps of locating a mould which has at least one mould cavity of variable volume above a receptacle containing molten metal, connecting a conduit between the mould cavity and the receptacle, said conduit having a first end connected to an entrance to the mould and a second end connected to the receptacle, forcing molten metal upwardly from the receptacle through the conduit and into the mould cavity without turbulence, preventing loss of molten metal from the mould cavity by sealing the entrance to the mould with a sliding gate which is moved from an open position which is below said mould cavity to a closed position which is also below said mould cavity, wherein during solidification of the molten metal pressure is applied to the mould cavity to reduce the volume thereby compensating for contraction during solidification.

20. A method as claimed in claim 19, wherein the pressure is reduced after solidification is completed.

21. A method as claimed in claim 20, wherein the mould is then opened and the cast article is removed from the mould.

* * * * *